United States Patent [19]

O'Neal

[11] Patent Number: 4,546,735

[45] Date of Patent: Oct. 15, 1985

[54] VALVE ACTUATOR

[75] Inventor: Glenn B. O'Neal, San Antonio, Tex.

[73] Assignee: Southwest Research Institute, San Antonio, Tex.

[21] Appl. No.: 572,875

[22] Filed: Jan. 23, 1984

[51] Int. Cl.[4] ..... F01L 1/34

[52] U.S. Cl. ..... 123/90.17; 123/90.31

[58] Field of Search ..... 123/90.15, 90.17, 90.31

[56] References Cited

U.S. PATENT DOCUMENTS

| | | | |
|---|---|---|---|
| 2,673,555 | 3/1954 | Randol | 123/90.53 |
| 2,907,311 | 10/1959 | Waldron | 123/90.15 |
| 3,313,280 | 4/1967 | Arutunoff et al. | 123/90.15 |

FOREIGN PATENT DOCUMENTS

| | | | |
|---|---|---|---|
| 752466 | 6/1954 | Fed. Rep. of Germany | 123/90.15 |

*Primary Examiner*—William R. Cline
*Assistant Examiner*—Peggy A. Neils
*Attorney, Agent, or Firm*—Vaden, Eickenroht, Thompson & Jamison

[57] ABSTRACT

There is disclosed an actuator which enables the intake valves which control the induction of a combustible fuel-air mixture into the combustion chambers of a spark-ignited or dual-fuel internal combustion engine to be opened for time intervals proportional to load or demand on the engine.

4 Claims, 12 Drawing Figures

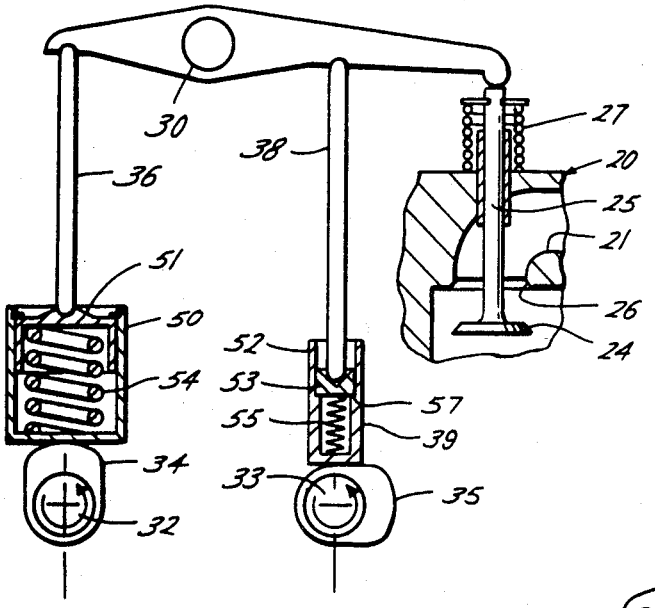
Fig. 3
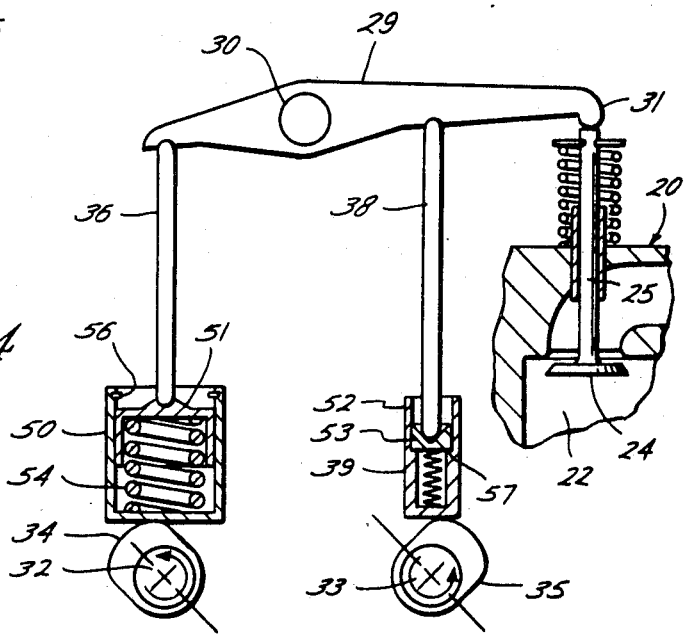
Fig. 4
Fig. 5
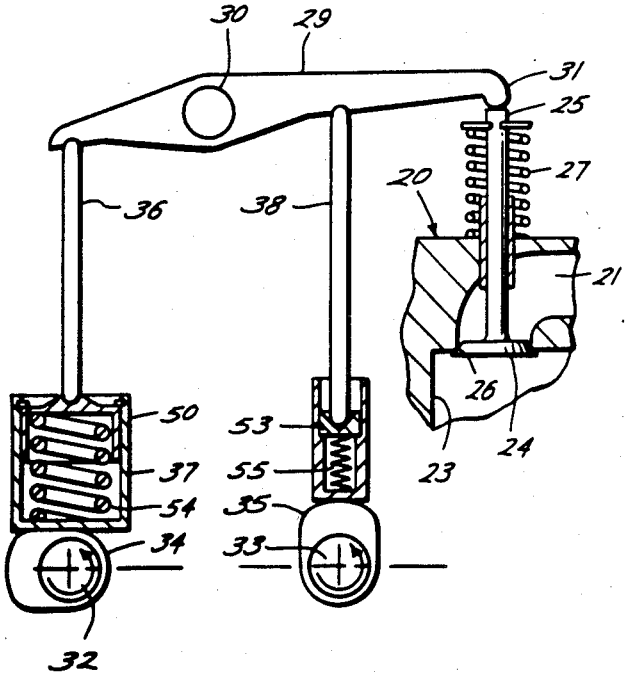

VALVE ACTUATOR

This invention relates in general to spark-ignited and dual-fuel types of internal combustion engines. More particularly, it relates to improved apparatus for controlling the quantity of combustible fuel-air mixture inducted into the combustion chambers of such engines and thus the power output of the engine.

The conventional practice for controlling the quantity of combustible fuel-air mixture in the combustion chambers of engines of this type, and thus the power output thereof, is to throttle the air intake and thus reduce the pressure of the mixture in the combustion chambers. However, the power required to so throttle the air reduces the efficiency of the engine at less than full load, and, in this sense, the engine is less fuel efficient than a diesel type internal combustion engine wherein the air is not throttled. The power output of the diesel engine is controlled by the quantity of fuel injected into the chambers.

The primary object of this invention is to provide apparatus which enables the power output of a spark-ignited or dual-fuel type of internal combustion engine to be controlled, depending on load or demand on the engine, without experiencing this power loss.

A more particular object is to provide an actuator which enables the point at which the intake valves to the combustion chambers may be opened or closed, and thus the time period in which the fuel-air mixture is inducted into the chambers, to be varied continuously, depending on the load or demand on the engine, such that the combustible fuel-air mixture may be inducted with minimum pressure loss.

These and other objects are accomplished, in accordance with the illustrated embodiment of this invention, by an actuator for the valve head of each intake valve of the engine which includes, as in conventional actuators, a pivotally mounted rocker arm having one end engageable with the outer end of the stem on which the valve head is carried, whereby the valve head is moved or lifted to open the intake conduit leading to the combustion chamber, upon pivoting of the rocker arm in one direction, and is permitted to be spring pressed to closed position upon pivoting of the rocker arm in the opposite direction. However, as compared with conventional actuators, the actuator of the present invention also includes first and second shafts rotatable about their axes and having first and second cams thereon, a first rod connected at one end to the rocker arm on the side of its axis opposite its one end which is engageable with the valve stem, a first follower on the other end of the first rod engageable by the first cam, a second rod connected at one end to the rocker arm intermediate the pivotal axis and one end of the rocker arm, and a second follower on the other end of the second rod engageable by the second cam, so that, as the shafts are rotated, one rod and its follower cause the rocker arm to pivot in one direction, and the other rod and its follower cause it to pivot in the other direction. More particularly, the shafts are so connected as to permit the phase angle between them to be varied continuously, in response to demand or load on the engine, so the time period in which the valve is open, and thus the quantity of fuel-air mixture inducted into the combustion chamber, is proportional to the demand or load—i.e., greater in response to increased demand and lesser in response to decreased demand—and the first and second rods and followers are axially extendible and retractible between extended and retracted positions and yieldably urged toward one position, so that, despite such changes in phase angle between the cams, the followers are maintained in engagement with the cams.

As illustrated, the rods and followers are yieldably urged to extended positions and compressed between the rocker arm and the cam, with the first rod and follower being arranged to pivot the rocker arm in said one direction and the second rod and follower being arranged to pivot the rocker arm in the opposite direction. More particularly, each follower is slidably connected to a shoe on the one end of the rod, and a spring is compressed between the follower and shoe to urge the rod to extended position.

In the drawings, wherein like reference characters are used throughout to designate like parts:

FIGS. 1 to 5 are diagrammatic illustrations of a valve and actuator constructed in accordance with the present invention, during rotation of the shafts through 180° to sequentially open and close the valve, while the cams are 90° out of phase with one another;

Figure 1:
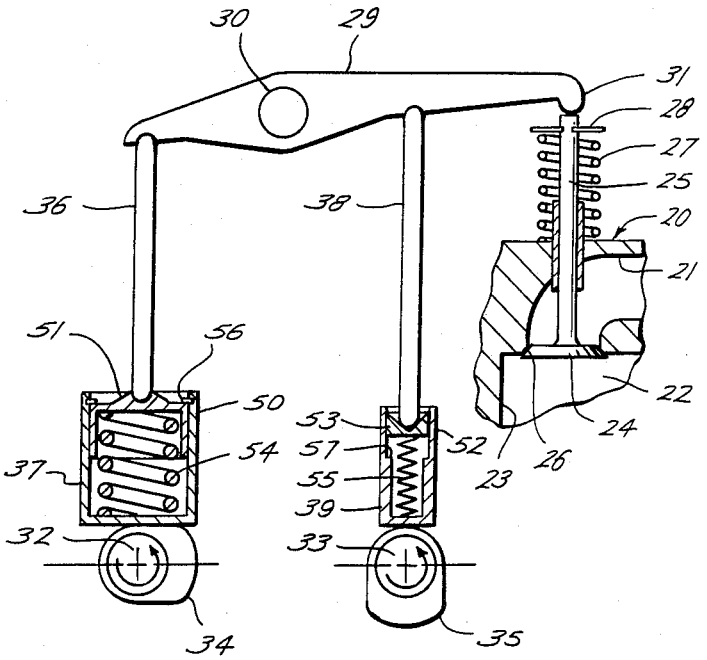

With reference now to the details of the above-described drawings, the portion of the engine block 20 shown in each of FIGS. 1 to 10 includes a conduit 21 connecting with a combustion chamber 22 above a piston (not shown) within a cylinder 23 formed in the block. As shown, the induction of combustible fuel-air mixture through the conduit 21 and into the chamber 22 is controlled by an intake valve which is of conventional construction in that it includes a valve head 24 on the lower end of a valve stem 25 guidably slidable within the block of the engine for reciprocation toward and away from a seat 26 formed about the intersection of the conduit with the chamber 22. More particularly, the valve head 24 is normally held against the seat to close the valve by means of a coil spring 27 disposed about the upper exterior end of the stem 25 and acting between the engine block and a spring retainer 28 about its upper end. Thus, the valve is closed until the valve head 24 is moved downwardly or "lifted" from the seat 26 by the application of a downward force to the upper end of the stem 25 through the actuator described below.

As shown, this actuator includes a rocker arm 29 which is mounted on a shaft 30 for pivoting about an axis perpendicular to the axis of reciprocation of the stem. The right-hand end 31 of the rocker arm is adjacent the upper end of stem 25 so as to lift valve head 24 from its seat, upon pivoting of the rocker arm in a clockwise direction, and, conversely, to permit the valve head to be spring-pressed to closed position upon pivoting of the rocker arm in a counterclockwise direction. First and second shafts 32 and 33 are mounted in laterally spaced-apart relation for rotation about parallel axes, and first and second cams 34 and 35 are mounted on the first and second shafts, respectively, for rotation therewith. More particularly, and as will be understood from the description to follow in connection with FIGS. 11 and 12, both shafts and thus the cams are connected to one another and the engine for rotation in the same direction (counterclockwise as shown in FIGS. 1 to 10) and at the same speed. In the illustrated embodiment of the invention, each of the cams 34 and 35 is of the same shape.

The actuator also includes a first rod 36 which is connected at its upper end to the left end of the rocker arm 29, and thus to the left of the pivotal axis of the rocker shaft 30, and a first follower 37 on the lower end of the first rod which is engageable by the first cam 34, and a second rod 38 which is connected at its upper end to the rocker arm intermediate the pivotal axis of the shaft 30 and the right-hand end 31 of the rocker arm, and a second follower 39 on the lower end of the second rod which is engageable with the second cam 35. As shown, each follower comprises a cup having its closed end engageable by the cam, and each rod has a shoe on its lower end axially reciprocable within the cup to permit the rod and follower to extend and contract.

Thus, as shown, the first follower includes a cup 50 having its closed end engageable with the first cam 34, and a shoe 51 on the lower end of the first rod is axially reciprocable within the cup. The second follower includes a cup 52 of considerably smaller diameter than the cup 50 and having its closed end engageable with the second cam 35, and a shoe 53 on the lower end of the second rod 38 is axially reciprocable in the cup 52. In each case, a coil spring is disposed between the shoe and the cup so as to urge the rod and its follower to extended position, and thus maintain the follower thereof in engagement with its respective cam throughout the opening and closing cycle of the valve. For this purpose, a coil spring 54 is compressed between the shoe 51 and cup 50, and a spring 55 is compressed between the shoe 53 and the cup 52. A snap ring 56 is received in a recess within the upper end of the cup 50 to limit upward movement of the shoe 51 with respect to the cup 50, and a shoulder 57 is formed on the inner diameter of the cup 53 so as to engage and thereby limit downward movement of the shoe with respect to the cup.

As will also be understood from the description to follow, changes in phase between the cams may take place continuously, in response to demand or load. Thus, those phases shown in FIGS. 1 to 5, wherein the first cam 34 leads the second cam 35 by 90°, and, in FIGS. 6 to 10, wherein the first cam is shown to lead the second cam by 45°, are merely illustrative, and the phase between the cams may be continuously varied between zero and 180° in response to demand or load on the engine. As will also be understood, in the illustrated embodiment of the invention, wherein the rods and followers are compressed between the rocker arm and cams, the first rod and follower serve to lift the valve head 24 from the seat 26 and open the valve, while the second rod and follower serve to permit the valve head to be moved onto the seat and the valve to close.

As shown in FIG. 1, the lobe of the first cam 34 is to the right of its center to permit the end 31 of rocker arm 29 to be raised by the rod 38 to a level at which spring 27 moves the valve head 24 to seated position. Thus, although the lobe of cam 35 is beneath its center, rod 38 and follower 39, like the rod 36 and follower 37, occupies their fully extended positions, with spring 55 serving to maintain the follower cup 39 engaged with the second cam 33, and spring 54 serving to maintain the follower cup 50 engaged with the cam 34.

Figure 2:
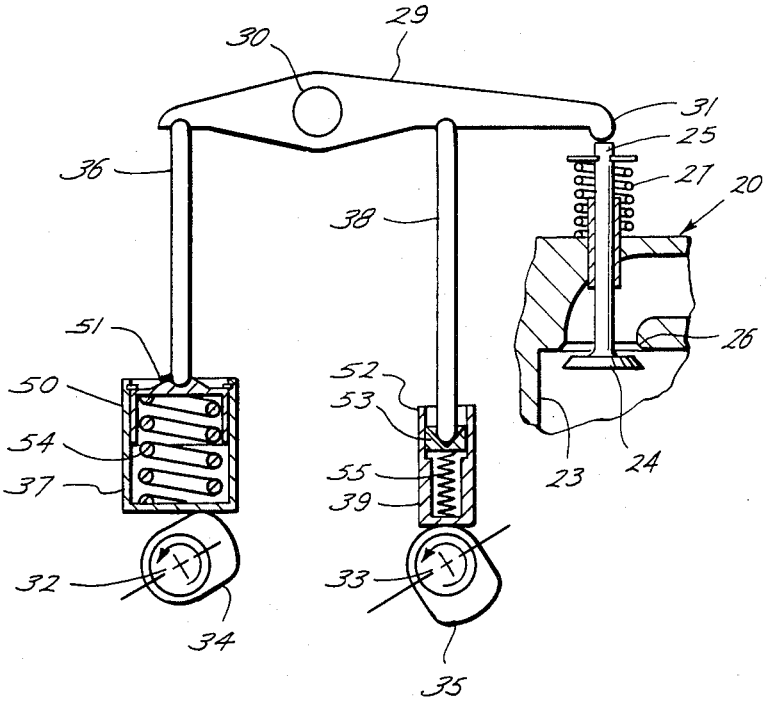

As the cams rotate approximately 30° in a counterclockwise direction, as shown in FIG. 2, and the lobe of the first cam 34 begins to raise the follower 37 on the first rod 36, which are maintained fully extended by spring 54 in order to pivot the rocker arm 29 in a counterclockwise direction, and thus urge the end 31 of the rocker arm downwardly against the valve stem 25 to lift the valve head 24 from the seat 26. Thus, spring 54 overcomes the force due to the springs 27 and 55, which merely serve, respectively, to hold the valve head 24 in closed position when the end 31 of the rocker arm is raised and maintain rod 38 and follower 39 extended. Since the spring 55 was fully extended in the closed position of the valve, as shown in FIG. 1, the shoe 53 is free to move downwardly within cup 52 as the rocker arm 29 pivots in a clockwise direction and spring 55 continues to hold follower 52 engaged with cam 35.

Upon rotation of the cams a further 60° to the position shown in FIG. 3, the lobe on the first cam 34 has achieved its maximum lift to lift valve head 24 to its fully open position. Shoe 53 has just contacted shoulder 57 so that any further rotation of cam 35 in the counterclockwise direction will cause follower 39 to begin to lift.

As shown in FIG. 4, when the cams 34 and 35 have been rotated in a clockwise direction an additional 45°, the lobe on the second cam 35 has moved to a position above its center, and, since the shoe 53 is bottomed out on the shoulder 57 in the cup 52, rod 38 is raised to pivot the rocker arm 29 in a counterclockwise direction, and thus permit valve head 24 to be spring pressed toward closed position. Thus, even though the lobe of cam 34 is still above center, the spring 54 is compressible to permit the shoe 51 to move downwardly within the follower cup 50 as the upper end of rod 36 is lowered.

As shown in FIG. 5, the cams have continued to rotate in a counterclockwise direction an additional 45°, and thus 180° from the position of FIG. 1, so as to dispose the lobe of the second cam 35 above its center. As a result, the second rod 38 is raised further to swing the rocker arm a still further distance in a counterclockwise direction in order to raise its end 31 to a position which permits spring 27 to move valve head 24 into seated position. At the same time, the lobe of the first cam is disposed to the left of its center, and spring 54 is fully extended to hold cup 50 engaged with cam 34.

As the cams continue to rotate in a counterclockwise direction a further 180°, from the position of FIG. 5, during a subsequent 360° of crank shaft rotation, the valve will remain closed since the lobe of the first cam 34 will be horizontally in line with or beneath the center of the cam 34.

Figure 6:
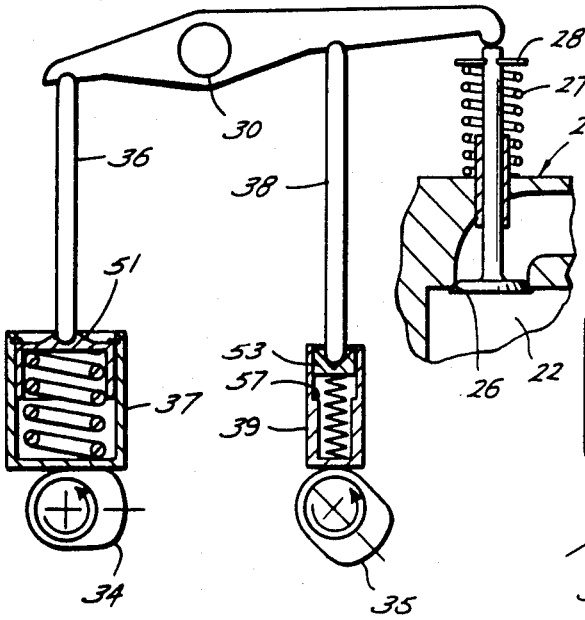
FIGS. 6 to 10 are similar diagrammatic illustrations of the valve and actuator of FIGS. 1 to 5, during rotation of their shafts through 135° to open and close the valve, while the cams are 45° out of phase.

As shown in FIG. 6, the first cam 34 occupies the same position shown in FIG. 1, while the second cam 35 has been moved 45° in a counterclockwise direction so that, as compared with FIG. 1, it is only 45° out of phase with the first cam 34. Despite this change in phase angle between the cams, the lobe of cam 35 is still beneath its center so that the rocker arm 29 occupies the same rotative position as shown in FIG. 1 so as to permit the valve to be closed.

Figure 7:
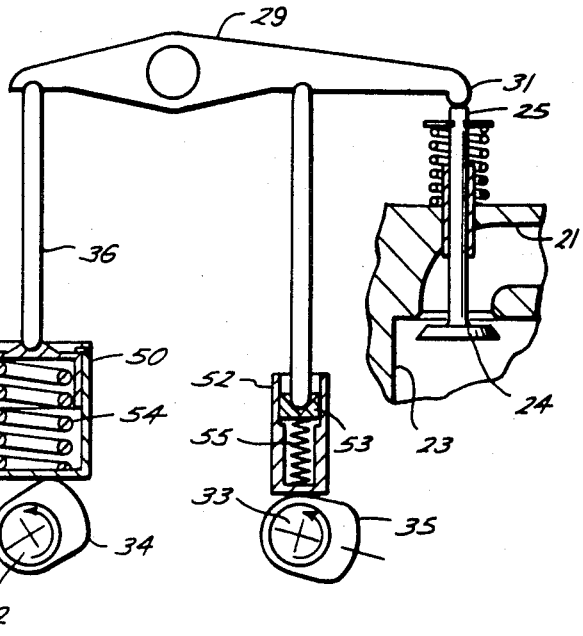

Although each of the cams has been rotated 30° in a counterclockwise direction, as shown in FIG. 7, the lobe of second cam 35 is still to the right of center, so that, as in the position of the cams shown in FIG. 2, movement of the valve is controlled by raising of rod 36 as the lobe of the first cam 34 moves to a position above center to cause the rocker arm to be swung in a clockwise direction so as to begin to open the valve. As before, shoe 53 is free to move downwardly in cup 55.

Figure 8:
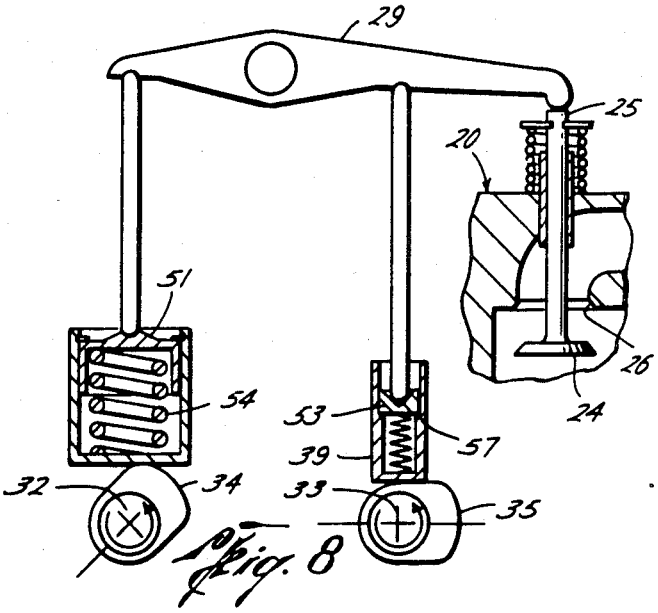

In like manner, upon a further 15° rotation of the cams in a counterclockwise direction, as shown in FIG. 8, the lobe of the second cam 35 is still to the right of its center, and the shoe 53 has just contacted shoulder 57 within the cup 52. Further rotation of cam 35 in the counterclockwise direction will therefore raise follower 39 and thus rod 38.

Figure 9:
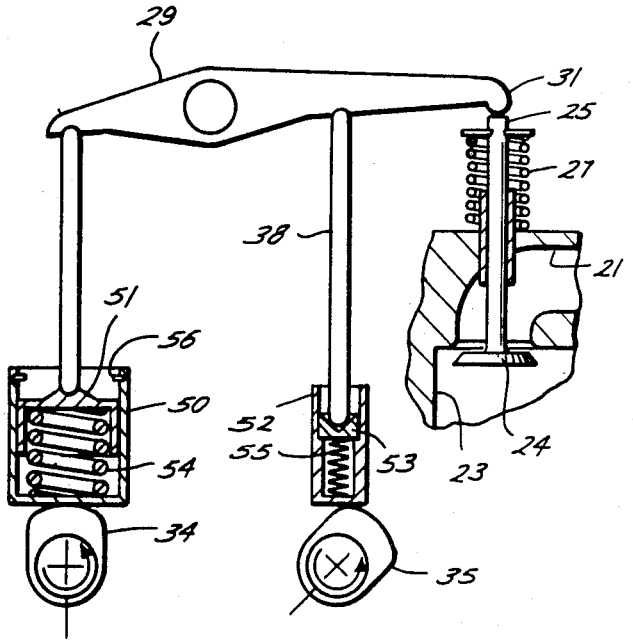

Thus, as shown in FIG. 9, the rocker arm 29 is swung in a counterclockwise direction to raise its end 31 to permit the spring 27 to move the valve head 24 toward closed position. At this time, as was true in connection with the stage of the opening and closing cycle shown in FIG. 4, although the lobe of cam 34 is above its center, the shoe 51 has moved downwardly within the cup 50 to compress the spring 54.

Figure 10:
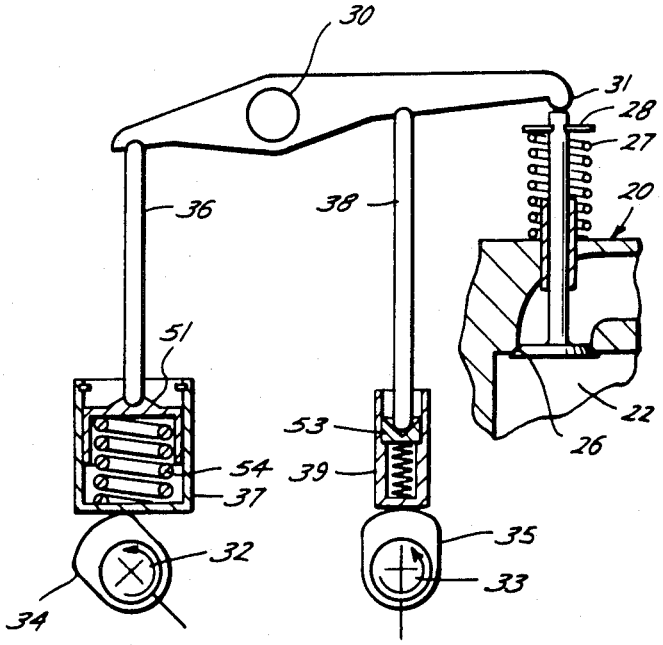

As shown in FIG. 10, the cams have moved in a counterclockwise direction a still further 45°, and thus 135° from the position of FIG. 6, so as to bring the lobe of the second cam 35 into a position directly above its center. Rod 38 then further pivots the rocker arm 29 in a counterclockwise direction to raise the end 31 of the arm to its uppermost position and thereby permit movement of the valve head into closed position. Although, during this time, the lobe of the first cam 34 is still above center, the spring 54 is still compressed by the shoe 51 to permit the rod 36 to be lowered a still further amount.

As will be understood, upon continued rotation of the cams 45° in a counterclockwise direction beyond the position shown in FIG. 10, the lobe of the second cam 35 will remain above center so as to maintain the end 31 of the rocker arm raised to a position in which the valve head is held closed as the lobe of cam 34 moves toward a position to the left of its center. Then, upon continued rotation of the cams in a counterclockwise direction to return them to the position of FIG. 6, as will occur during a further 360° rotation of the crank shaft, the lobe on the first cam 34 will remain either in horizontal alignment with or beneath the center of the cam so that the valve will remain closed.

Figure 12:
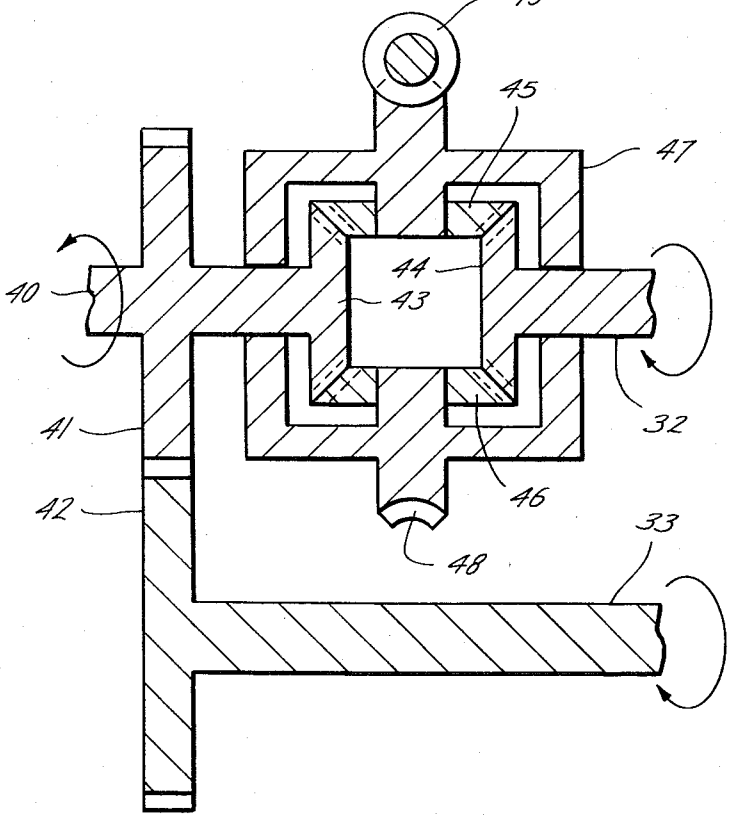
FIG. 12 is a cross-sectional view of the connection as seen along broken lines 12—12 of FIG. 11.
Figure 11:
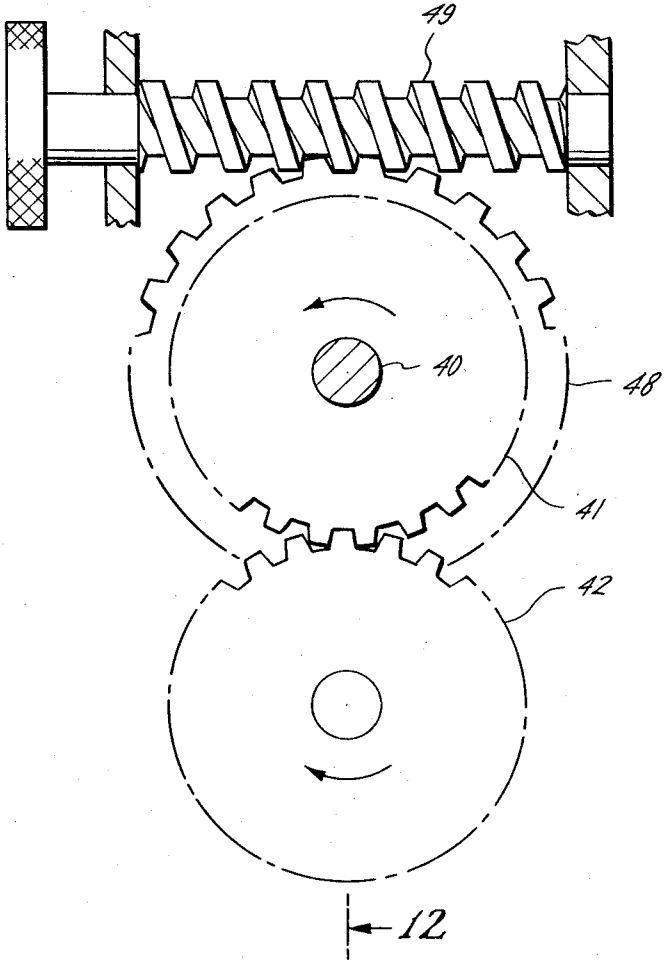
FIG. 11 is an end view of the connection of the cam shafts to one another and the engine for continuously varying the phase of the cams with respect to one another.

As previously described, and as shown in FIGS. 11 and 12, the cam shafts 32 and 33 are so connected to one another and to part of the engine which is responsive to the load thereon as to permit the phase angle between them to be continuously varied, and thus the valve to be held open for a time period proportional to such demand. Thus, cam shaft 33 is driven by a shaft 40 through spur gears 41 and 42 of equal size, and the cam shaft 32 is aligned with the shaft 40 and rotated in a direction opposite thereto, and thus in the same direction as the shaft 33, by pinion gears 43 and 44 on the oppositely facing ends of the shafts 40 and 32 and connected by pinion gears 45 and 46 mounted on and rotatable with a pinion carrier 47. The pinion carrier has a worm gear 48 thereabout which is adapted to be driven in opposite directions by means of a worm 49 suitably mounted for rotation about an axis perpendicular to the axes of rotation of the shafts 32, 33 and 40. Thus, the worm gear 48 is adapted to be rotated in response to demand or load on the engine in order to vary the phase relation of the cam 32 with respect to the cam 33 in order to hasten or delay opening of the valve. Obviously, rotation of the worm gear in one direction will increase the lead of the first cam with respect to the second cam, and thus hasten opening of the valve, while rotation thereof in the opposite direction will decrease the lead of the first cam with respect to the second cam, and thus delay opening of the valve.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. In an internal combustion engine having a cylinder, a piston reciprocable within the cylinder to form a combustion chamber on one side thereof, a conduit connecting with the combustion chamber, a valve for opening and closing the conduit, including a valve seat about the conduit, a stem guidably reciprocable within the engine block, a valve head on the inner end of the stem for movement therewith toward and away from the seat, and spring means acting between the stem and block to urge the head toward the seat; an actuator for moving the head between conduit opened and closed positions, comprising a pivotally mounted rocker arm having one end engageable with the outer end of the stem, whereby the valve head is moved away from the seat to open the conduit upon pivoting of the rocker arm in one direction, and is permitted to move toward the seat to close the conduit upon pivoting of the rocker arm in the opposite direction, first and second shafts rotatable about their axes, first and second cams on the first and second shafts, respectively, a first rod connected at one end to the rocker arm on the side of the pivotal axis of the arm opposite the one end of the arm, a first follower on the other end of the first rod engageable by the first cam, a second rod connected at one end to the rocker arm intermediate the pivotal axis of the arm and the one end of the arm, a second follower on the other end of the second rod engageable by the second cam, means so connecting the shafts as to permit the phase angles between the cams to be continuously varied, the first and second rods and followers being axially extendible and retractible with respect to one another between extended and retracted positions, and spring means acting between each rod and its follower to yieldably urge them toward one such position so that, despite such changes in phase angle between the cams, the followers are maintained in engagement with the cams as the shafts are rotated to cause one rod and its follower to pivot the rocker arm in one direction and the other rod and its follower to pivot the rocker arm in the other direction, the spring means acting between the rod and its follower which pivots the rocker arm in said one direction providing a force which overcomes the force acting between the stem and block but yields to the force exerted by the other rod and follower pivoting the rocker arm in said opposite direction if both rods and followers exert opposing forces simultaneously on the rocker arm.

2. An actuator of the character defined in claim 1, wherein each rod and follower are yieldably urged to extended position and compressed between the rocker arm and cam at their opposite ends, and the first rod and follower are arranged to pivot the rocker arm in said one direction and the second rod and follower are arranged to pivot the rocker arm in said opposite direction.

3. An actuator of the character defined in claim 1, wherein each follower is slidably connected to the other end of the rod, and a spring is disposed between the follower and other end of the rod to urge the rod and follower to such one position.

4. An actuator of the character defined in claim 3, wherein each spring is compressed between the follower and other end of the rod, the first rod pivots the rocker arm in said one direction, and the second rod pivots the rocker arm in said other direction.

* * * * *